United States Patent [19]

Barclay

[11] Patent Number: 4,901,929

[45] Date of Patent: Feb. 20, 1990

[54] ROTARY SHEARING WHEEL WITH INDIVIDUALLY REPLACEABLE CUTTING SEGMENTS

[76] Inventor: Randel L. Barclay, 5616 Carpenter Rd., Stockton, Calif. 95205

[21] Appl. No.: 349,587

[22] Filed: May 8, 1989

[51] Int. Cl.[4] ..... B02C 4/08

[52] U.S. Cl. ..... 241/236; 83/500; 83/673; 241/294

[58] Field of Search ..... 76/101 A; 83/673, 675, 83/500, 838; 241/DIG. 31, 236, 235, 294, 295, 293

[56] References Cited

U.S. PATENT DOCUMENTS

| | | | |
|---|---|---|---|
| 3,570,566 | 3/1971 | McCreery | 241/294 X |
| 3,931,935 | 1/1976 | Holman . | |
| 4,374,573 | 2/1983 | Rouse et al. . | |
| 4,607,800 | 6/1985 | Barclay . | |
| 4,776,249 | 10/1988 | Barclay . | |

FOREIGN PATENT DOCUMENTS 3413614 10/1985 Fed. Rep. of Germany .

*Primary Examiner*—Mark Rosenbaum
*Attorney, Agent, or Firm*—Thomas Schneck

[57] ABSTRACT

A shearing wheel, and a method of assembling the same, having individually demountable cutting elements or tool members side mounted to a mounting region of an annular member. The tool members are mounted in successive abutting relation so that a portion of each tool member extends radially beyond the annular member. This extending portion forms a toothlike structure for feeding and ripping waste material. A support shoulder extending axially from the annular member contacts and supports the tool members. The tool members may be individually removed and resharpened, whereafter shims are positioned between the tool members and the annular member to properly space the tool members from an adjacent shearing wheel.

21 Claims, 4 Drawing Sheets

ROTARY SHEARING WHEEL WITH INDIVIDUALLY REPLACEABLE CUTTING SEGMENTS

DESCRIPTION

1. Technical Field

The invention relates to apparatus for conversion of solid waste materials into small pieces by ripping and shearing.

2. Background Art

The problem of disposing bulky solid waste materials is receiving increasing attention as land fills become full and available land for waste disposal decreases. Preferably, waste material, such as old appliances and tires, is reduced in size at an early stage of the waste disposal process. Among the reasons for size reduction are volume densification and the requirements of subsequent processing, such as burial or combustion.

Apparatus that reduce the size of waste material have been developed which use paired shearing wheels to shred the waste material into smaller pieces. For example, U.S. Pat. Nos. 4,607,800 to Barclay, 4,374,573 to Rouse et al. and 3,931,935 to Holman disclose machines in which counter-rotating shearing wheels overlap so that the edges of the wheels cut the waste material like giant pairs of scissors. The Rouse et al. and Barclay machines further make use of ripping wheels which are paired and driven so that waste material is forced into the shearing wheels. Because of the difficulty in cutting and ripping solid waste, extremely hard materials must be employed in constructing the shearing wheels. Therefore, a chrome alloy tool steel is used. Such materials are very expensive and, given the low profit margin of waste recycling, are often cost prohibitive.

German patent No. 3,413,614 discloses a machine for cutting up tires which reduces the cost of manufacturing cutting wheels. Each wheel has a core made of tough high tensile steel with the blade edges being formed from a layer of wear-resistant metal which is deposited onto the steel core by welding. However, the cutting wheels require complete replacement upon wear of the blades.

The Holman patent teaches an overlapping pair of shearing wheels in combination with a pair of stripping wheels. The stripping wheels are taught to be solid with a saw tooth outer periphery. Holman addresses the problem of wear in the shearing wheels by providing overlapping shingle type cutting members on the outer circumferential periphery of a shearing wheel. The stripping wheels of Holman follow the shearing wheels.

The Rouse et al. patent teaches a machine for shredding waste materials in which two different pairs of rotating wheels or sets of wheels cooperate to shred the solid waste material. An upper pair of wheels which are solid and have a saw-tooth outer periphery feed waste material into the lower shearing wheels. Rouse et al. addresses the problem of wear in the shearing wheels in a similar fashion to Holman, in that overlapping shingle type cutting members are provided on the outer circumferential periphery of the shearing wheels.

Barclay, in U.S. Pat. No. 4,607,800 addresses the problem of wear in both a lower pair of shearing wheels and a upper pair of ripping wheels, by providing wear shoes and cutting tool sections over the outer periphery of the respective fields. The outer periphery of the upper ripping wheels has a modified triangular or saw-tooth shape. The lower shearing wheels are piecewise smooth.

Barclay, in U.S. Pat. No. 4,776,249 discloses a cutting wheel for use in solid waste shredding machines which incorporates side mounted sections that have a saw-tooth formed outer periphery. These cutting sections are mounted to the side face of an annular carrier and extend a prescribed axial distance outward from the side face so that a close relationship is maintained between a counter-rotating wheel, thereby providing a shearing action. Shims are used to maintain this prescribed distance as the faces of the cutting sections are worn down.

Baikoff teaches a cutting wheel in U.S. Pat. No. 4,241,882, in which cutting elements are side mounted to a shaft collar. Each cutting element contains an inverted U-shaped cutting nose. Counter rotating and interleaving wheels of this type are used to cut and shear waste material, in particular rubber tires.

Because there is non-uniformity in the hardness of the materials fed through a solid waste comminution machine, there is often uneven wear or broken teeth in the cutting wheels. For example, when a refrigerator or other household appliance is fed through the machine, the sheet metal portions generally cause little damage to the cutting wheels. However, the motor, compressor or similar hard objects in the appliance can cause considerable damage and breakage to individual cutting teeth or elements. When individual teeth or elements become worn, the efficiency of the comminution machine decreases. The prior art cutting wheels have not adequately addressed the problem of non-uniform wear.

It is an object of the present invention to provide in a comminution machine a combined material feeding and cutting wheel that has an outer periphery suitable for feeding and shearing solid waste materials. It is another object of the present invention to devise a cutting wheel that is inexpensive to make and maintain.

SUMMARY OF THE INVENTION

The above objects have been met by a shearing wheel having individually demountable cutting elements that can easily be made from planar steel stock. The shearing wheel has a predetermined number of uniform tool members mounted and arranged around a first side face of an annular member. The tool members are arranged to successively abut one another so that a portion of each tool member extends radially beyond the annular member. In a preferred embodiment each tool member has a planar top and a right angled end. Opposite to the right angled end is an acutely angled end whose angle depends on the number of tool members used. Opposite to the top is a spherically curved bottom surface. When the predetermined number of tool members are laid right angled end to acutely angled end with the bottom surfaces forming a circle, the acutely angled ends extend radially outward from the abutting right angled ends to form teeth. The teeth serve to feed material into the pinch points of counter-rotating shearing wheels.

The tool members are positioned with a major surface mounted to a first side face of the annular member via bolts, which penetrate the annular member and engage threaded holes in the tool members. Each tool member has a major surface opposite to the one mounted to the side face, that forms a shearing edge. The shearing edges of one wheel may be placed in shearing cooperation with a counter-rotating shearing wheel. The tool members may be demounted and surface ground flat to obtain a sharp shearing edge. Shims placed between the tool members and the annular member may be used to position the tool members in proper shearing relation.

Optionally, the first side face of the annular member includes a support shoulder that extends axially outward for contacting the bottom surface of the tool members. The support shoulder should have an axial extent that is less than the width of the tool members so that the shearing edges of the tool members extend axially beyond the support shoulder. Further, the annular member may include a second side face and associated support shoulder. Tool members as previously described are mounted to the second side face slightly rotationally offset from the tool members mounted to the first side face.

In addition to removable tool members the shearing wheel may include optional wear plates that are removable. These wear plates may be mounted on the sides and circumferential periphery of the wheel to provide further protection to the wheel and an inexpensive means for repairing damaged wheels.

An advantage of the present invention is found in that wear critical to the performance of the shearing wheel takes place at the shearing edges and extending teeth of the tool members. The present invention allows individual tool members with a worn shearing edge or broken tooth to be resharpened or replaced. Therefore, only those tool members that are worn or broken need be removed.

Another advantage is the ease, and relatively low cost in which tool members are made. Tool members can be simply cut from a planar steel bar, machined, and then hardened. Machining a saw tooth periphery into the tool members is not required because of the shape and unique arrangement of the tool members. A considerable savings is obtained in making shearing wheels in this way. This advantage is particularly important with the low profit margin of waste recycling and processing.

BEST MODE FOR CARRYING OUT THE INVENTION

Figures 1, 1A, 4:
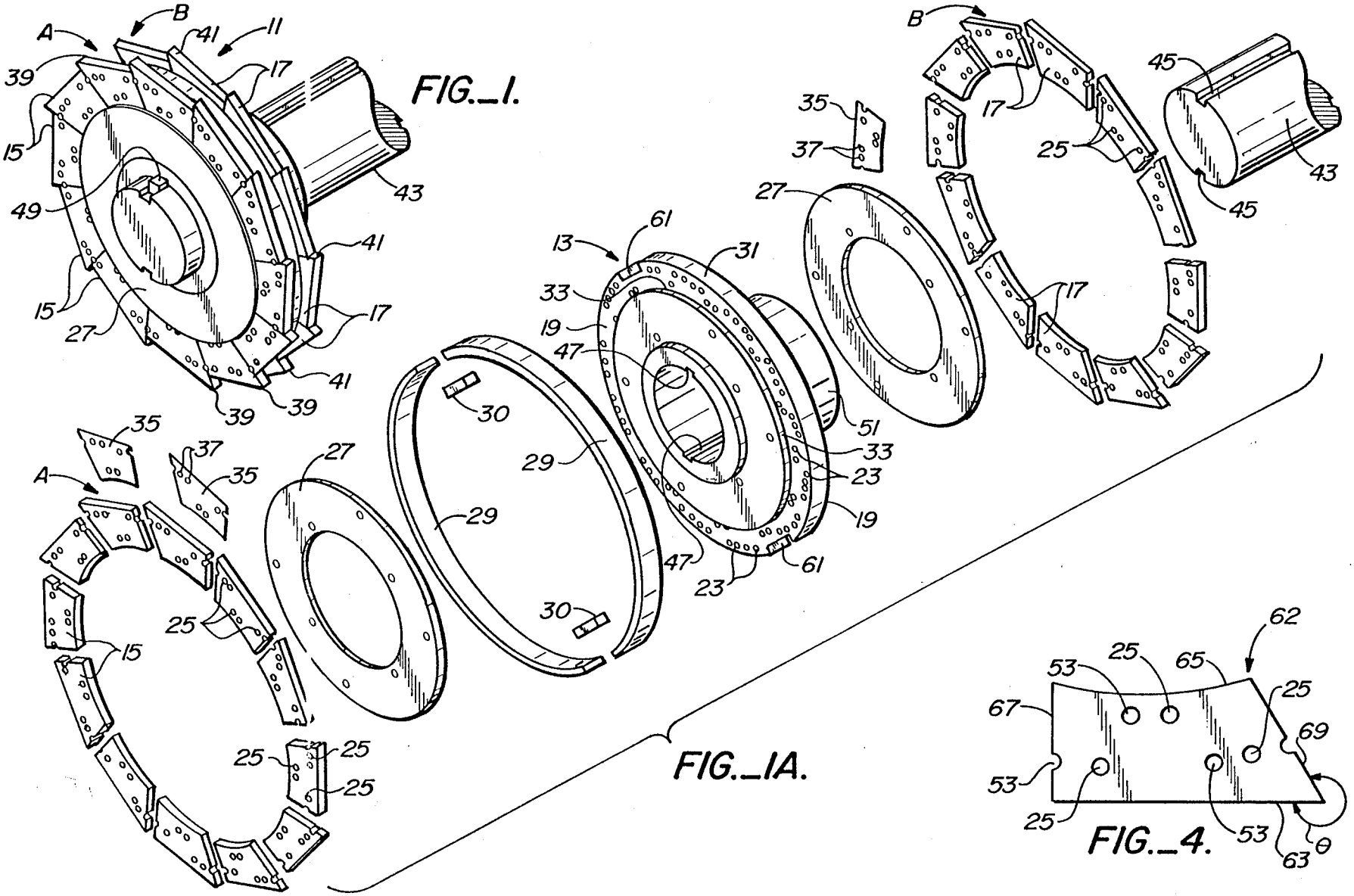
FIG. 1 is a perspective view of a shearing wheel in accord with the present invention.
FIG. 1A is an exploded view of the shearing wheel of FIG. 1.
FIG. 4 is a side view of a tool member used in the shearing wheel of FIG. 1.

With reference to FIGS. 1 and 1A, a shearing wheel 11 includes an annular member 13 and two sets A and B of tool members 15 and 17, respectively. Each set of tool members 15 and 17 are mounted to a side face 19 of the annular member by a plurality of bolts 21, shown in FIG. 3, which penetrate bores 23 of the annular member 13 to engage corresponding threaded holes 25 in the tool members.

The tool members 15 and 17 are mounted so that a radially inward surface of each contacts a support shoulder 33 which extends axially outward from the annular member 13. Shims 35 may be used to space apart selected tool members 15 and 17 from the annular member 13. Each shim 35 has holes 37 for passage of the bolts 21. The tool members preferably extend axially outward beyond the support shoulder 33 relative to side face 19. Furthermore, a portion of each tool member extends radially outward beyond the circumferential periphery 31 of the annular member 13 to form a tooth 39 or 41.

The annular member 13 is optionally protected by annular wear plates 27 and circumferential wear plates 29. The annular wear plates 27 are attached to the side faces 19 via bolts or screws 55, shown in FIGS. 2 and 3. These bolts engage with the annular member 13 to removably attach the annular wear plates 27. The circumferential wear plates 29 are held to the outer periphery 31 of the annular member 13 using bolts and connector plates 30 described more fully in relation to FIG. 2. The annular wear plates may extend axially beyond the tool members.

Each set A and B of tool members 15 and 17 is arranged in an end-to-end fashion to define an inner radius and a jagged outer periphery. The jagged outer periphery is formed from the teeth 39 and 41 that extend from the abutment of adjacent tool members. The teeth 39 of set A are illustrated as being rotationally offset from the teeth 41 of set B. However, an offset arrangement is not necessary.

The tool members 15 and 17 are made of a chrome alloy tool steel or similar material, while the annular member 13 is made of plain carbon steel, such as type 4340. The various parts of shearing wheel 11 are preferably machined before being heat treated. In a preferred embodiment the tool members have an axial width of approximately 1 inch and average radial height in the range of 1.5 to 6.0 inches. A portion of each tool member, the tooth, extends approximately $\frac{5}{8}$ inch beyond the abutting adjacent tool member. The major radial diameter of the wheel as measured from the extending teeth is approximately 25 and $\frac{5}{8}$ inches and the minor radial diameter measured from the circumferential coverplate 29 is 23 inches. The materials used to make the shearing wheel 11 are not critical so long as the tool members are constructed from a hardened, wear resistant material suitable for cutting into discarded tires, appliances and the like.

The shearing wheel 11 is mounted onto a shaft 43. One side of a hub 51 may include a pair of bolts, not shown, to secure the shearing wheel 11 to the shaft 43. The shearing wheel is positioned on the shaft by keyways 45 on the circumference of the shaft 43 and by corresponding keyslots 47 at the inside diameter of the annular member 13. Keys 49 fit between the keyways 45 and keyslots 47.

Figure 3:
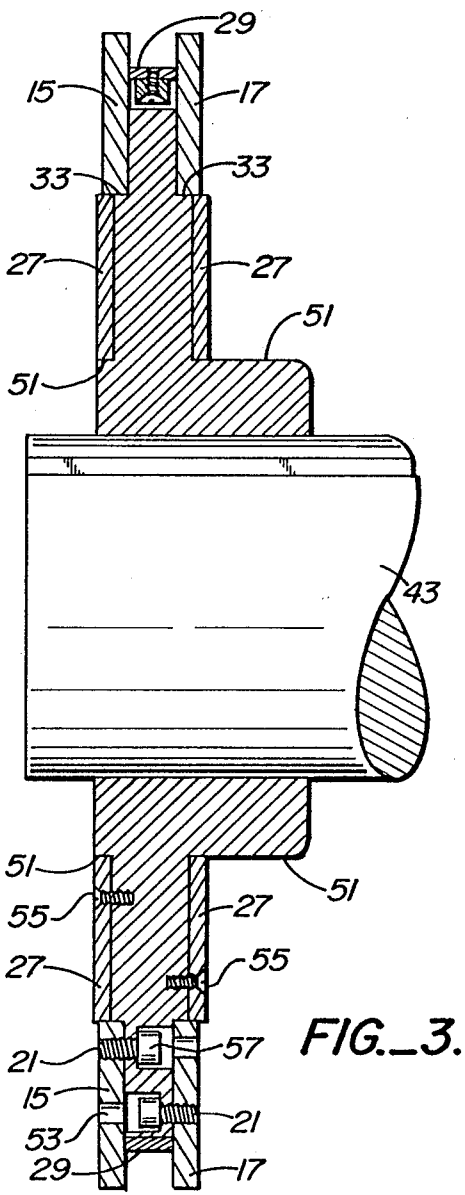
FIG. 3 is a partial cutaway view taken along line 3—3 in FIG. 2.
Figure 2:
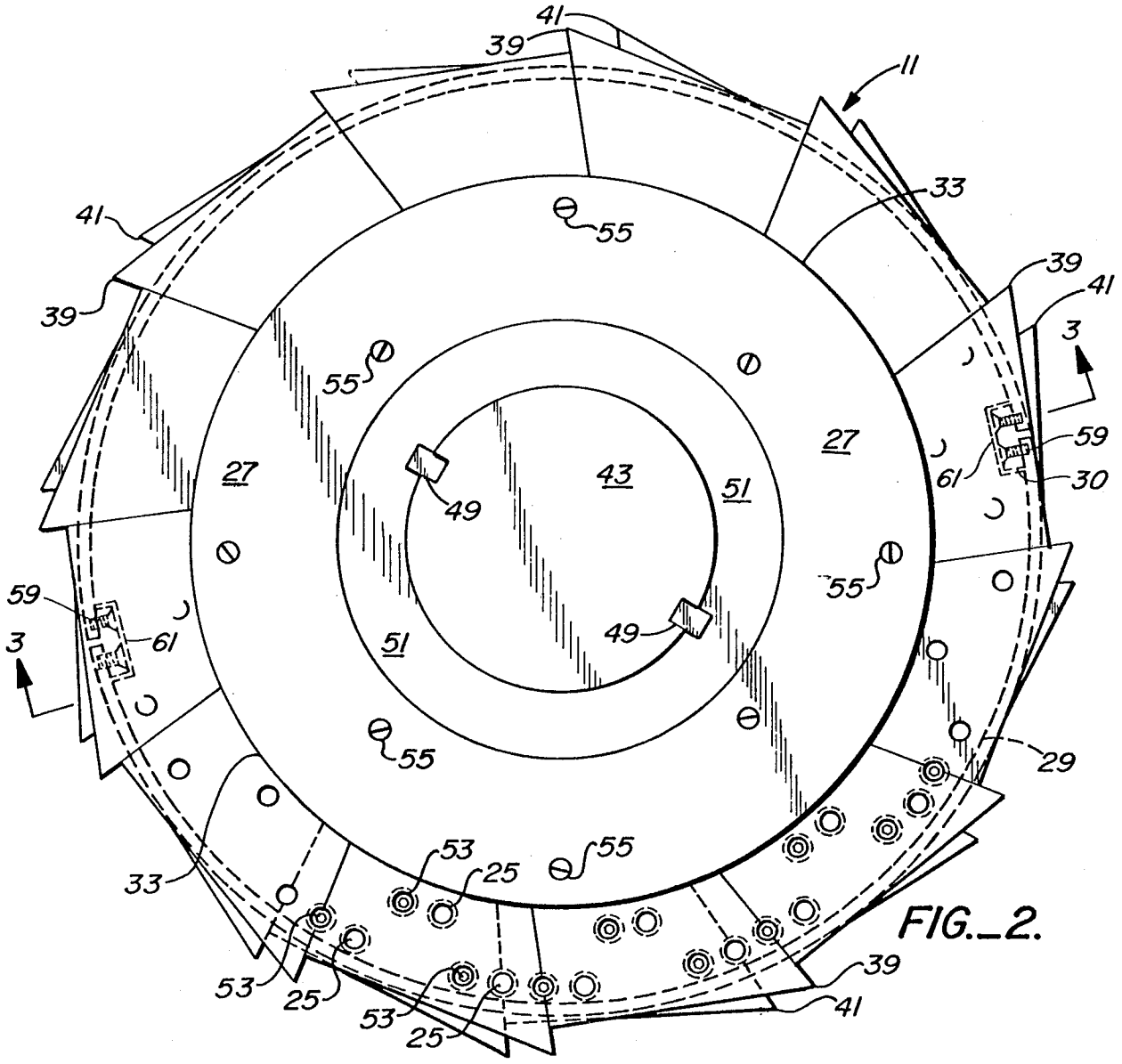
FIG. 2 is a side view of the shearing wheel of FIG. 1.

Referring now to FIG. 2 and FIG. 3, the shearing wheel 11 is mounted on shaft 43 with keys 49 providing torsional transfer of rotation. Moving radially outward is hub 51 and then annular wear plates 27. The inner diameter of the annular wear plates 27 is slightly larger than the outer diameter of the hub 51 so that the annular wear plates fit over the hub. Bolts or screws 55 secure the annular wear plates 27 to a side of the shearing wheel 11. The outer diameter of the annular wear plates 27 coincides with the support shoulders 33. A curved inner surface of each tool member 15 and 17 contacts one of the support shoulders. Threaded holes 25 are provided in the tool members, so that bolts 21 on the opposite side of the annular member 13 engage with the threaded holes, to secure the tool members to the annular member. The tool members are also provided with access holes 53 through which bolt heads 57 can be accessed for tightening or loosening the bolts 21 which engage with the threaded holes of the tool members on the opposite side of the annular member 13. The bolt heads 57 have hexagonal recesses for engagement with a hex key tool. Because the diameter of the access holes 53 is less than the diameter of the bolt heads 57, the bolts 21 are confined within the annular member 13 until the tool member blocking it is removed. In a preferred embodiment, the bores 23 are counterbored ½ inch to give clearance for the bolt heads 57. The total axial width of the annular member 13 at the bores 23 is 1.000 inches.

The circumferential wear plates 29 are mounted to the outer periphery 31 of the annular member 13 using connector plates 30 and screws 59. Two circumferential wear plates 29 are warm mounted to the annular member 13 so that their ends meet at notches 61 in the annular member. The circumferential wear plates are constructed such that there is a slight gap between the wear plates. A connector plate 30 at each notch 61 is secured onto the ends of the wear plates by screws 59. As the circumferential wear plates 29 cool and contract, a secure fit is achieved.

Turning now to FIG. 4, a tool member 62 includes threaded holes 25 and access holes 53. The tool member 62 has a planar outer surface 63 and a curved inner surface 65. The curve of the inner surface 65 matches the circular curve of the support shoulder 33, shown in FIG. 2. Relative to the planar outer surface 63, the tool member 15 also includes a right-angled end 67 and an acutely-angled end 69. The angle indicated by $\theta$ of the acutely-angled end 69 is determined by the number of tool members that make up a set of tool members. The following equation yields angle $\theta$:

$$\theta = 90° - (360°/n);\ n > 5$$

where n is the number tool members in a set. A minimum of five tool members is required and a range of 12 to 24 tool members per set is preferred.

Tool member 62 is cut from a planar steel bar and then machined. The machining includes forming the curved inner surface 65 in the member. Threaded holes 25 are drilled and tapped, while access holes 53 are drilled into the member. As shown, the right and acutely angled ends contain half of an access hole that coincides with a half hole on an adjacent tool member, to form a complete access hole 53 when mounted. While a specific layout of threaded and access holes is shown, it will be appreciated that other layouts may be used so long as the holes in the tool members match up and align with the bores and bolts in the annular member. After machining, the tool member may be hardened.

Figure 5:
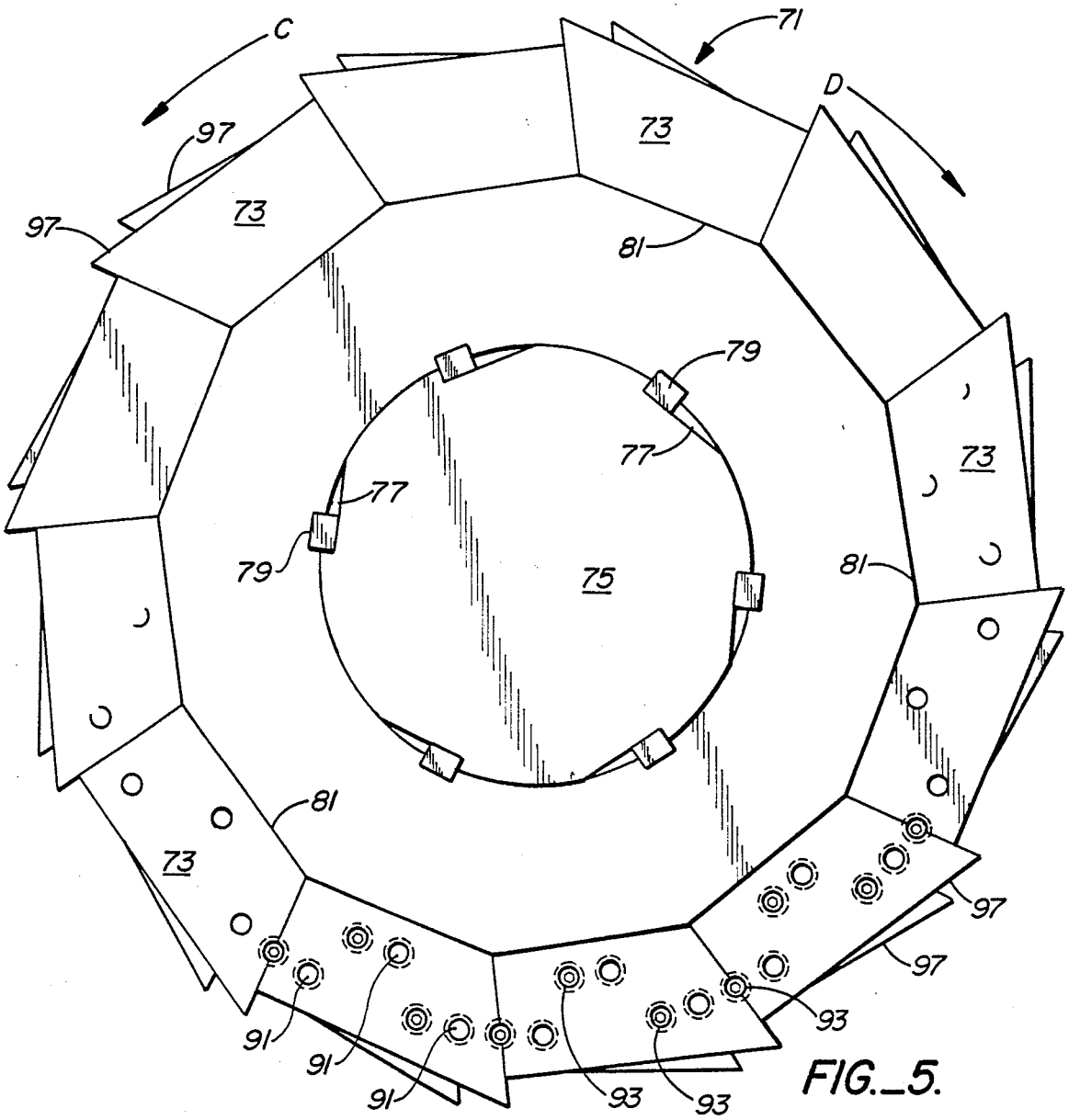
FIG. 5 is a side view of a second embodiment of the shearing wheel of FIG. 1.
Figure 6:
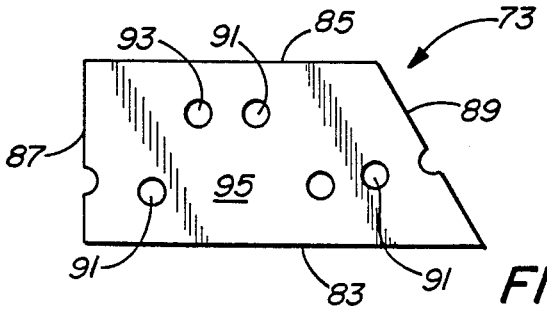
FIG. 6 is a side view of a tool member used in the shearing wheel of FIG. 5.

With reference to FIGS. 5 and 6, a second embodiment is illustrated to include a shearing wheel 71 having a predetermined number of tool members 73 mounted to each side of the wheel. The shearing wheel 71 is removably mounted on a shaft 75. The shaft 75 has a plurality of triangular notches 77 in the circumference of the shaft 75. A plurality of corresponding rectangular keys 79 are press fit into the inner circumference of the shearing wheel 71. As the shearing wheel 71 rotates in the direction indicated by arrow C, the rectangular keys 79 slide up the incline of the triangular notches 77 providing a secure mounting. The shearing wheel 71 may be loosened and removed from the shaft 75 by rotating the wheel relative to the shaft in the direction indicated by arrow D.

Shearing wheel 71 includes a polygonal-shaped support shoulder having a predetermined number of sides 81. Each tool member 73 has a planar outer surface 83 and a planar inner surface 85 that contacts a side 81 of the support shoulder. Each tool member 73 further has a right-angled end 87 and an acutely-angled end 89, and a shearing surface 95. The tool members 73 are mounted to a side face of the shearing wheel such that the acutely-angled end 89 of one tool member abuts the right-angled end 87 of an adjacent tool member. A portion of the acutely-angled end 89 extends beyond the abutting right-angled end 87 to form a tooth-shaped extension. The tool members 73 are secured to the shearing wheel 71 by bolts which engage threaded holes 91. Access holes 93 are also provided in the tool members 73 as described previously. The intersection of the planar outer surface 83 and the shearing surface 95 defines a shear or cutting edge 97. Since the inner surface 85 of the tool member 73 is planar, a tool member 73 may simply be cut from a planar steel bar with very little machining required.

Figure 7:
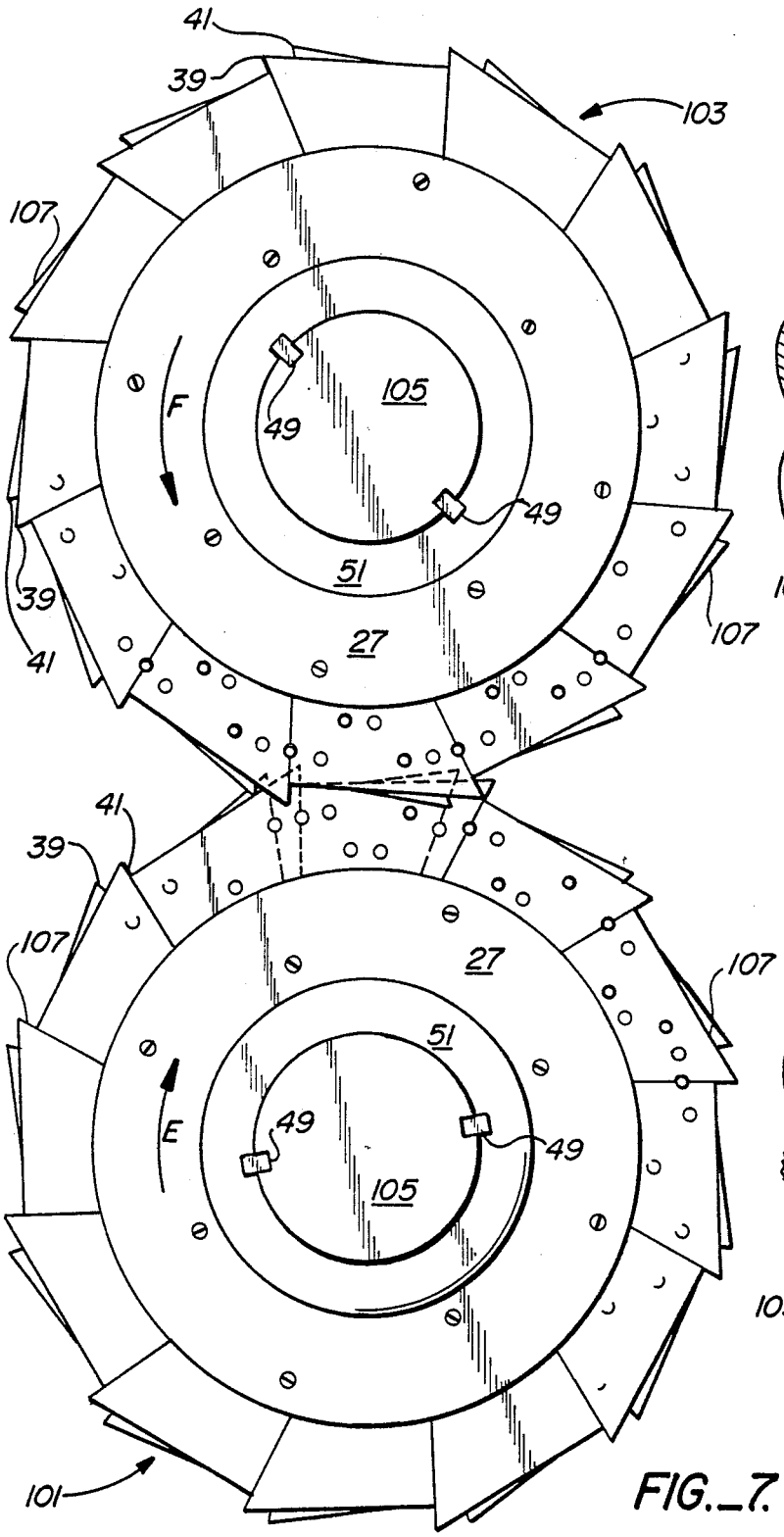
FIG. 7 is a side view of a pair of shearing wheels of FIG. 1 in material shearing cooperative engagement.
Figure 8:
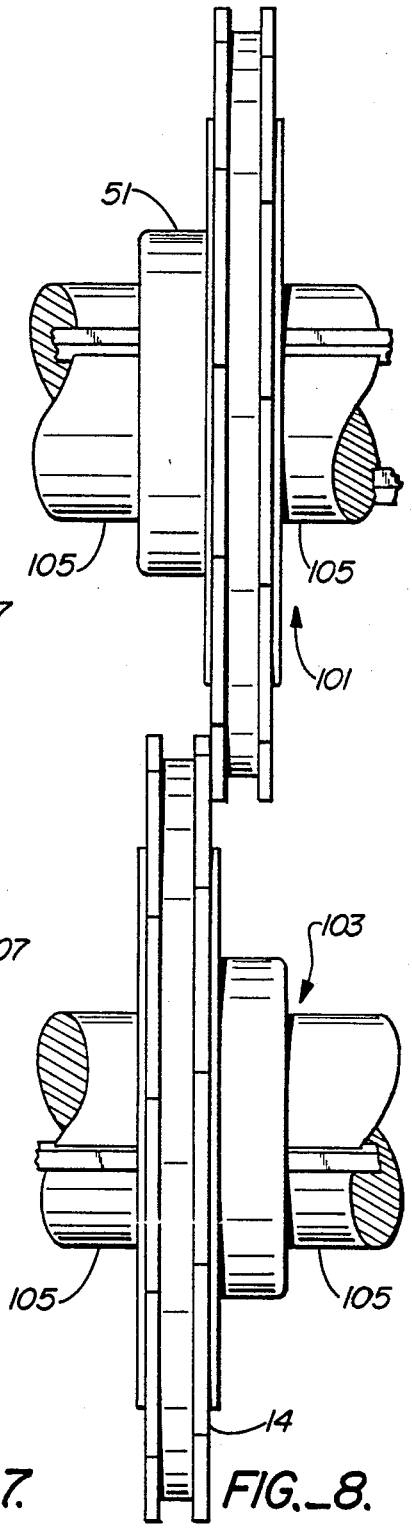
FIG. 8 is a rear view of the shearing wheels of FIG. 7.

In operation at least two counter-rotating shearing wheels are required in a waste material shredding machine. FIGS. 7 and 8 show a pair of shearing wheels 101 and 103 in counter-rotating shearing engagement. The directions of rotation for shearing wheels 101 and 103 are indicated by arrows E and F respectively. The shearing wheels 101 and 103 are mounted on parallel shaft 105 by keys 49. Several shearing wheels may be deployed on the shafts 105 for shearing engagement. The shearing wheels 101 and 103 overlap a certain distance and are maintained in a close axial relation. Tool members 17 of shearing wheel 101 engage with tool members 17 of shearing wheel 103. Excessive clearance between shearing edges 107 causes the wheels to tear rather than cut the waste material, while too close of a clearance causes premature wear of the shearing edges 107. Preferably, the axial clearance should be 0.002 inch and should not exceed 0.03 inch. Due to the arduous nature of shearing waste material, the shear edges 107 will become dull and the shearing surfaces will become worn. When wear is excessive in a particular tool member, that tool member can be removed and its shearing surface can be ground flat to restore a sharp shearing edge. Shims may be positioned between the tool member and the side of the shearing wheel to maintain a proper clearance. The shearing wheels 101 and 103 are further protected by wear plates 27 mounted to the wheels between hub 51 and the tool members.

The extending teeth 39 and 41 of the shearing wheels 101 and 103 provide the advantage of positively feeding waste material into the shear points of the counter-rotating wheels. Moreover, the teeth can rip the waste material thereby providing a shearing and ripping action. While shearing wheels with two sets of tool members have been described and shown in the drawings, a shearing wheel may have only one set of tool members mounted to a side.

I claim:

1. A rotary shearing wheel comprising, an annular member having a central axis of rotation and opposed first and second side faces separated by an outer rim, the first side face having a mounting region located near said outer rim, and a first plurality of at least five tool members removably mounted to the mounting region of the first side face in successive abutting relation, each tool member having opposed inner and outer major surfaces separated by opposing leading and trailing edges, the leading and trailing edges separating a radially outward facing upper surface and a radially inward facing lower surface, the inner major surface contacting the first side face, the leading and trailing edges of successive tool members mounted with the leading edge of one tool member abutting the trailing edge of an adjacent tool member in an offset manner, each tool member having a tooth portion extending beyond said outer rim, with each abutment of successive tool members forming a single radially extending tooth, the number of teeth about the annular member equalling the number of tool members mounted to the mounting region.

2. A shearing wheel of claim 1 further comprising a second plurality of tool members, substantially like said first plurality, removably mounted to a mounting region of said second side face in successive abutting relation with a tooth portion of each tool member extending beyond said rim in like manner to said first plurality of tool members.

3. The shearing wheel of claim 2 wherein each tool member has a plurality of internally threaded bores parallel to said axis of rotation, said tool members being mounted to said side faces by bolts penetrating said annular member for engagement with the internally threaded bores.

4. The shearing wheel of claim 3 wherein said first plurality of tool members has access holes coaxial with said bolts engageable with the tool members of said second plurality and said second plurality of tool members has access holes coaxial with said bolts engageable with the tool members of said first plurality.

5. The shearing wheel of claim 2 wherein said first plurality of tool members are rotationally offset from said second plurality of tool members.

6. The shearing wheel of claim 2 wherein each of said first and second side faces have an axially outward extending support shoulder in contacting support relation with the lower surface of each tool member of said first and second plurality respectively.

7. The shearing wheel of claim 6 wherein each support shoulder has a plurality of planar sides forming a polygonal configuration, the number of sides corresponding to the number of said tool members.

8. The shearing wheel of claim 1 wherein said first side face has an axially outward extending support shoulder in contacting support relation with the lower surface of each tool member of said first plurality.

9. The shearing wheel of claim 1 further comprising shim members disposed between the tool members of said first plurality and said first side face.

10. The shearing wheel of claim 1 wherein said tool members have a material hardness at least as hard as hardened steel.

11. The shearing wheel of claim 1 further comprising wear plates removably mounted to said first and second side faces and said outer rim.

12. A rotary shearing wheel comprising, an annular member of a first radius having a central axis of rotation and opposed first and second side faces separated by a circumferential rim, the circumferential rim having an outer radial extent equal to the first radius, the first side face having an axially outward extending support shoulder with a radial outward extent less than the circumferential rim and a mounting region between the support shoulder and the circumferential rim, and a first set of a predetermined number of at least five tool members removably mounted to the mounting region of the first side face in successive abutting relation, each tool member having a portion extending beyond the circumferential rim, the tool members each having opposed inner and outer major surfaces separated by opposed leading and trailing edges, the leading and trailing edges separating and intersecting a radially outward facing planar upper surface and a radially inward facing lower surface, the inner major surface contacting the first side face with the outer major surface generally perpendicular to the axis of rotation and the lower surface contacting the support shoulder, the leading and trailing edges of successively abutting tool members mounted with the leading edge of one tool member abutting the trailing edge of an adjacent tool member in an offset manner with each abutment forming a single radially extending tooth, the number of teeth extending about the annular member equalling the predetermined number of tool members.

13. The shearing wheel of claim 12 wherein said support surface is annular in configuration having a second radius substantially less than said first radius.

14. The shearing wheel of claim 12 wherein said support shoulder has a plurality of planar sides forming a polygonal configuration, the number of sides corresponding to said predetermined number of tool members.

15. The shearing wheel of claim 12 wherein the axial extent of said tool members exceeds the axial extent of the support shoulder.

16. The shearing wheel of claim 12 further comprising shim members disposed between said tool members and said first side face.

17. The shearing wheel of claim 12 wherein said second side face includes an axially outward extending support shoulder and a support region between the support shoulder and said circumferential rim, said second side face and support shoulder removably supporting a second set of tool members in a similar manner as said first set, the second set of tool members being substantially like said first set.

18. The shearing wheel of claim 17 wherein said first set of tool members are rotationally offset from said second set.

19. The shearing wheel of claim 12 further comprising wear plates removably mounted to said first and second side faces and said circumferential rim.

20. Resharpenable rotary shearing apparatus of the type having at least two shearing wheels, including a first wheel on a first shaft and a second wheel mounted on a second shaft parallel to the first shaft, the first and second shafts being spaced apart such that the first and second wheels have thicknesses bringing said wheels into a material shearing relation, the improvement comprising, a pair of adjacent wheels, each having an annular member with a side face, the side face having an axially outward extending support shoulder and a mounting region to which a plurality of tool members are removably mounted in successive abutting relation, each tool member having a portion extending beyond a radius of the annular member, and contacting the support shoulder, each tool member further having an inner major surface joined to the mounting region and an outer major surface in material shearing cooperative engagement with a tool member of an adjacent wheel, each tool member also having opposed leading and trailing edges each of which abuts the opposing edge of an adjacent tool member when the tool members are mounted to the mounting region, the leading edge of one tool member extending radially outward beyond the abutting trailing edge of the adjacent tool member, each abutment between adjacent tool members forming a single radially extending tooth, and shim means for adjusting the spacing between each tool member and an adjacent wheel, maintaining a material shearing thickness between the adjacent wheels, the shim means being disposed between the tool member and the mounting region of the annular member.

21. The apparatus of claim 20 wherein said side face of the annular member is a first side face, said annular member having a second side face with an axially outward extending support shoulder and mounting region for mounting a second plurality of tool members.

* * * * *